US009738947B1

(12) United States Patent
Deshpande et al.

(10) Patent No.: US 9,738,947 B1
(45) Date of Patent: Aug. 22, 2017

(54) FRAGMENTATION DEVICE WITH INCREASED SURFACE HARDNESS AND A METHOD OF PRODUCING THE SAME

(71) Applicant: The United States of America as represented by the Secretary of the Navy, Washington, DC (US)

(72) Inventors: Nishkamraj U. Deshpande, Novi, MI (US); Eric Scheid, Bloomington, IN (US); James E. Schwabe, Bedford, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 368 days.

(21) Appl. No.: 14/689,696

(22) Filed: Apr. 17, 2015

Related U.S. Application Data

(60) Provisional application No. 61/981,249, filed on Apr. 18, 2014.

(51) Int. Cl.

| | |
|---|---|
| ***F42B 12/22*** | (2006.01) |
| ***C21D 9/16*** | (2006.01) |
| ***C23C 8/22*** | (2006.01) |
| ***C21D 1/06*** | (2006.01) |
| ***F42B 12/24*** | (2006.01) |

(52) U.S. Cl.
CPC ..... *C21D 9/16* (2013.01); *C21D 1/06* (2013.01); *C23C 8/22* (2013.01); *F42B 12/24* (2013.01); *C21D 2211/008* (2013.01)

(58) Field of Classification Search
USPC ..... 102/493, 495
See application file for complete search history.

(56) References Cited

U.S. PATENT DOCUMENTS

| | | | |
|---|---|---|---|
| 3,655,466 | A | 4/1972 | Ostrovsky et al. |
| 3,783,790 | A | 1/1974 | Polcha |
| 3,956,989 | A | 5/1976 | Sallade et al. |
| 4,043,808 | A | 8/1977 | Watmough et al. |
| 4,664,035 | A | 5/1987 | Osofsky |
| 5,040,464 | A | 8/1991 | Pearson |
| 5,095,821 | A | 3/1992 | Merz |

(Continued)

FOREIGN PATENT DOCUMENTS

| | | |
|---|---|---|
| GB | 1342093 | 12/1973 |

*Primary Examiner* — J. Woodrow Eldred
(74) *Attorney, Agent, or Firm* — Christopher A. Monsey

(57) ABSTRACT

A method of modifying material properties of a fragmentation device, includes providing a fragmentation device with a first surface, a first section, a second section, a second surface spaced apart from the first surface, a third section, and a fourth section disposed between the first, second, and third sections. The method further includes positioning the fragmentation device within a carbon-rich environment, and absorbing carbon from the carbon-rich environment into the first and second surfaces of the fragmentation device. Additionally, the method further includes increasing a content of carbon at the first and second surfaces of 0.06 wt. % carbon to 1.0 wt. % carbon and maintaining an original content of carbon of 0.01 wt. % carbon to 0.05 wt. % carbon at the fourth section of the fragmentation device by controlling penetration of the carbon into the fourth section.

19 Claims, 12 Drawing Sheets

(56) References Cited

U.S. PATENT DOCUMENTS

| | | | | |
|---|---|---|---|---|
| 5,157,225 | A * | 10/1992 | Adams | F42B 12/24 102/493 |
| 6,484,642 | B1 * | 11/2002 | Kuhns | F42B 12/24 102/493 |
| 6,502,515 | B2 | 1/2003 | Burckhardt et al. | |
| 6,962,634 | B2 | 11/2005 | Nielson et al. | |
| 7,093,542 | B2 | 8/2006 | Gousman et al. | |
| 7,921,778 | B2 | 4/2011 | Stawovy | |
| 8,973,503 | B2 | 3/2015 | Dunaway et al. | |
| 2009/0050334 | A1 | 2/2009 | Marya et al. | |
| 2010/0242774 | A1 | 9/2010 | Arrenbrecht et al. | |
| 2013/0255524 | A1 | 10/2013 | Simon et al. | |
| 2014/0230682 | A1 | 8/2014 | Bonnstetter et al. | |
| 2016/0367720 | A1 * | 12/2016 | Pawar | A61F 2/30767 |

* cited by examiner

FRAGMENTATION DEVICE WITH INCREASED SURFACE HARDNESS AND A METHOD OF PRODUCING THE SAME

CROSS-REFERENCE TO RELATED APPLICATION

The present application claims the benefit of U.S. Provisional Patent Application Ser. No. 61/981,249, filed on Apr. 18, 2014, and entitled A SYSTEM AND PROCESS FOR PRODUCING A STRUCTURE OR COMPONENT ADAPTED FOR SELECTIVE DAMAGE, DESTRUCTION, OR STRUCTURAL DEGRADATION BY A COMPATIBLE MODE OF FORCE GENERATION WITHIN END USE DESIGN CONSTRAINTS," the complete disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 103,258) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND OF THE PRESENT DISCLOSURE

A fragmentation device may be any device configured for fragmentation during use of the device. For example, for military applications, fragmentation devices include grenades, bullets, or other ammunition which are configured to fragment into multiple pieces upon detonation of an explosive.

Historically, the material used for a military fragmentation device is ductile and, therefore, the material of the fragmentation device may not rupture uniformly throughout at designed fracture locations. More particularly, when an explosive is ignited, the ductility of the material results in only partial fragmentation. As such, historical military fragmentation devices may fragment into a few larger fragments rather than many smaller fragments at designed fracture locations. The ductility of the material allows a majority of the remaining segments to be plastically deformed, but not fractured. Thus a majority of the material may remain with the body of the military fragmentation device.

SUMMARY OF THE PRESENT DISCLOSURE

In one exemplary embodiment of the present disclosure, a method of modifying material properties of a fragmentation device, includes providing a fragmentation device with a first surface, a first section extending from the first surface, a second section disposed on at least one side of the first section and extending from the first surface, a second surface spaced apart from the first surface, a third section extending from the second surface, and a fourth section disposed between the first, second, and third sections. The first section of the fragmentation device has a first thickness and the second section of the fragmentation device has a second thickness less than the first thickness. An area of the first surface is greater than an area of the second surface. The method further includes positioning the fragmentation device within a carbon-rich environment, increasing the temperature within the carbon-rich environment up to 1,200° C., and absorbing carbon from the carbon-rich environment into the first and second surfaces of the fragmentation device. Additionally, the method further includes increasing a content of carbon at the first and second surfaces of 0.06 wt. % carbon to 1.0 wt. % carbon and maintaining an original content of carbon of 0.01 wt. % carbon to 0.05 wt. % carbon at the fourth section of the fragmentation device by controlling penetration of the carbon into the fourth section.

In another exemplary embodiment of the present disclosure, a method of manufacturing a fragmentation device includes selecting a material for a fragmentation device. The material includes a first surface, a second surface generally opposite the first surface, and an intermediate section disposed between the first and second surfaces. A width of the first surface is greater than a width of the second surface. The method also includes forming a plurality of first sections and a plurality of second sections on at least one of the first and second surfaces of the material. Each of the second sections is disposed along at least one side of each of the first sections, and a thickness of the first sections is greater than a thickness of the second sections. Additionally, the method includes forming the material into a shape defining the fragmentation device, increasing a carbon content of the first and second surfaces of the material, maintaining a carbon content of the intermediate section by controlling penetration of carbon into the intermediate section, and positioning an energetic device within the fragmentation device.

In a further embodiment of the present disclosure, a fragmentation device includes a fragmentation structure with a first surface, a first section extending inwardly from the first surface, a second section disposed on at least one side of the first section and extending inwardly from the first surface, a second surface spaced apart from the first surface, a third section extending from the second surface, and a fourth section disposed between the first, second, and third sections. The first section of the fragmentation structure has a first thickness and the second section of the fragmentation structure has a second thickness less than the first thickness. A carbon content of the first and second sections is greater than a carbon content of the third section. An area of the first surface being greater than an area of the second surface. The fragmentation device further includes an explosive material positioned within the body.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
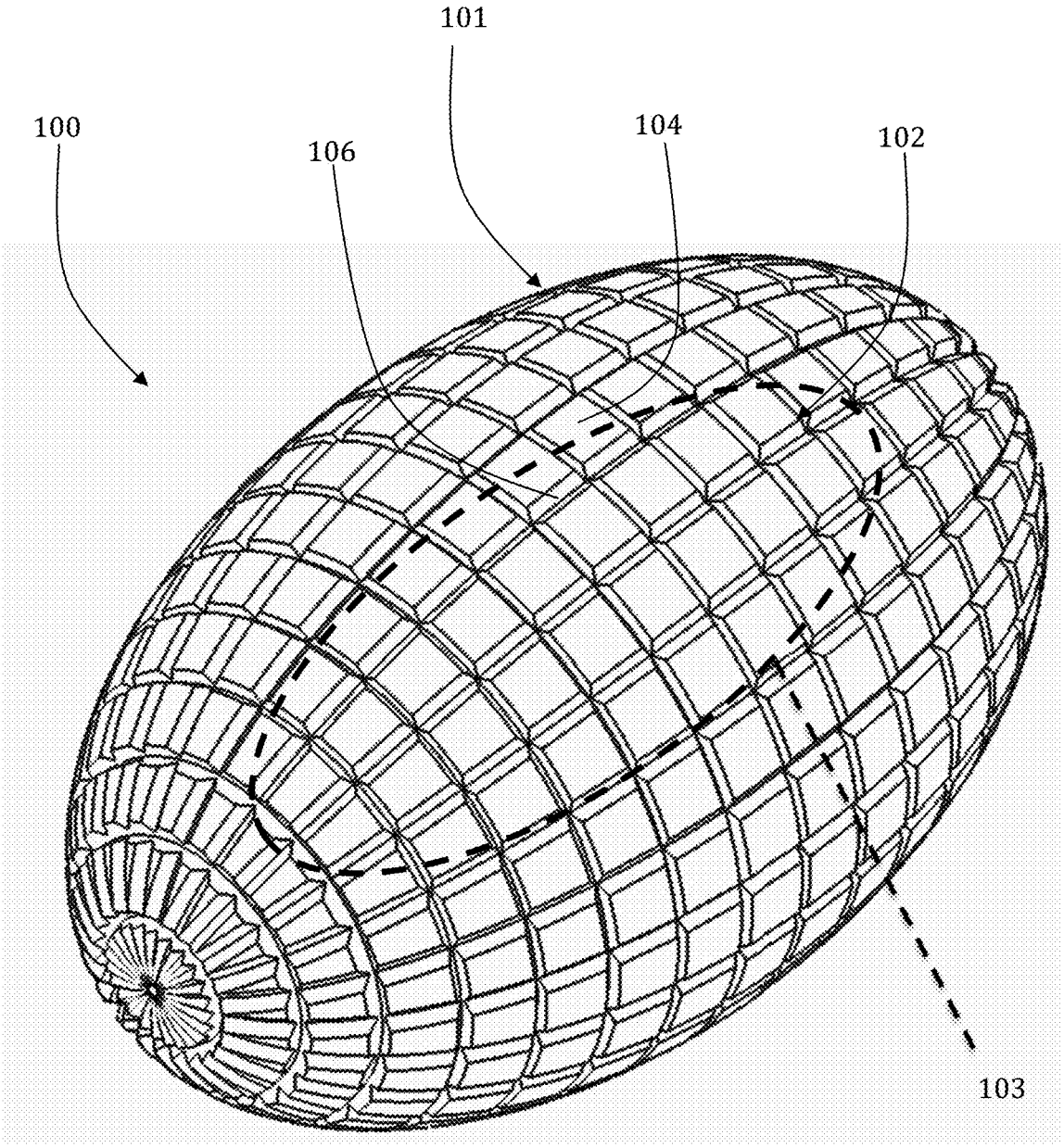
FIG. 1 is a perspective view of an exemplary fragmentation device of the present disclosure.

According to an illustrative embodiment of the present disclosure, a fragmentation device 100 includes a body or fragmentation structure 101 which generally surrounds an energetic device, illustratively an explosive material or core 103, as shown in FIG. 1. Body 101 may be comprised of a metallic, polymeric, and/or ceramic material, depending on the application of fragmentation device 100. Illustratively, fragmentation device 100 is a munition device defining a grenade comprised of a metallic material, however, fragmentation device 100 may be a bullet, missile, other ammunition, or any other device configured to fragment into a plurality of components. Alternatively, fragmentation device 100 may have non-military applications, such as a computer hard drive or an electrical component.

Figure 2:
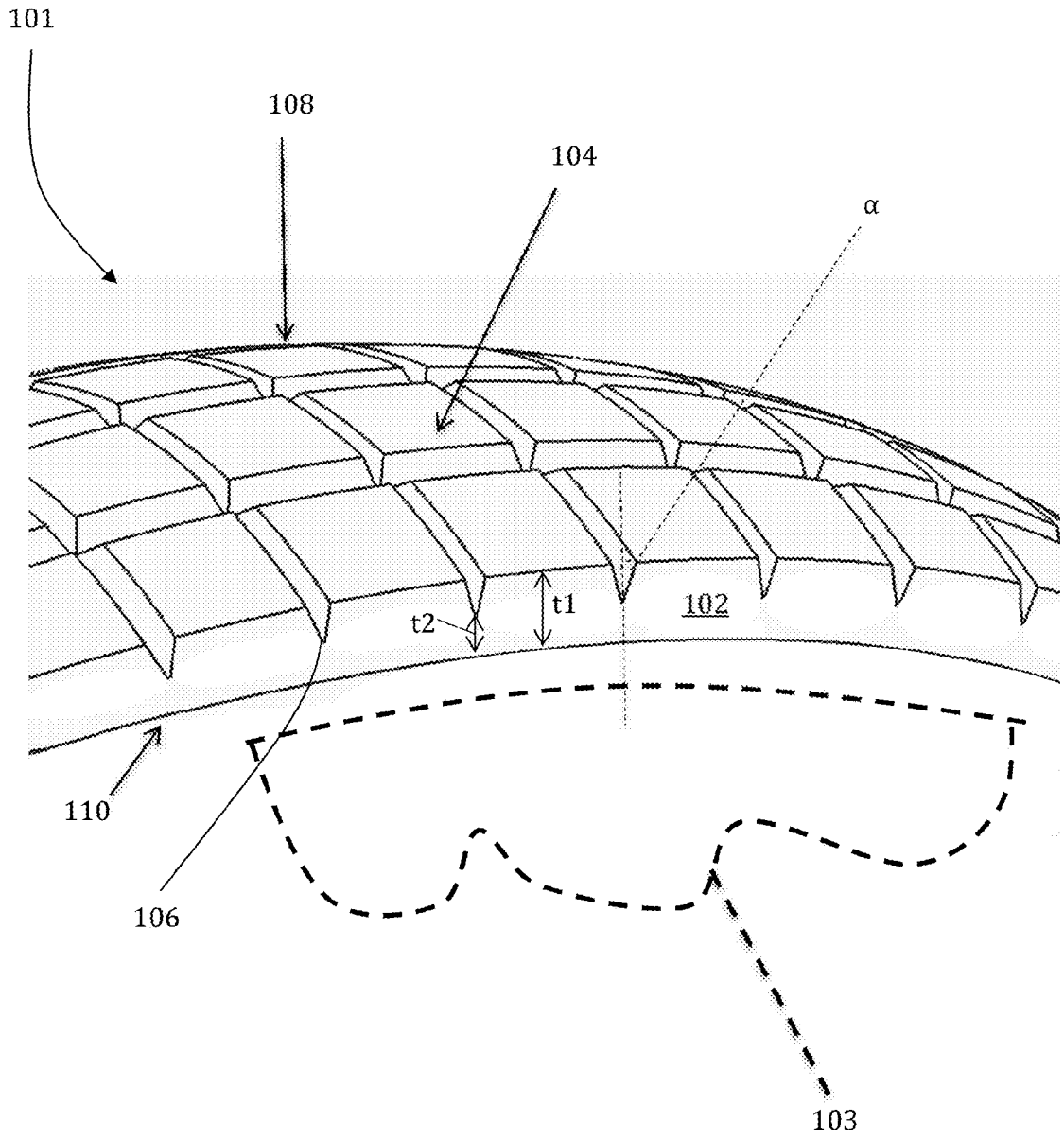
FIG. 2 is a partial cross-sectional view of a surface of the fragmentation device of FIG. 1, with an explosive core shown in phantom.

Referring to FIGS. 1 and 2, body 101 of fragmentation device 100 includes an outer surface 108, defining the outermost surface of body 101, and an inner surface 110, defining the innermost surface of body 101. While exemplary inner surface 110 is a smooth and continuous surface, exemplary outer surface 108 of body 101 includes a pattern or grid 102 of projections 104, defined as raised portions, and valleys 106, defined as grooves, within the material of body 101 that surrounds explosive material 103. Projections 104 define the individual fragments of fragmentation device 100 such that when explosive material 103 ignites, body 101 is intended to fracture at each valley 106 and project fragments, defined by each projection 104, outwardly. Illustratively, projections 104 define square fragments, however, projections 104 may be formed in any configuration to define differently shaped fragments. In one embodiment, the thickness of body 101 at projections 104 may be approximately 0.050 inches, 0.055 inches, 0.060 inches, 0.065 inches, 0.070 inches, 0.075 inches, 0.080 inches, 0.085 inches, 0.090 inches, 0.100 inches, or within any range delimited by any of the foregoing pairs of values. The thickness of body 101 also may be orders of magnitude greater, for example, 1.0-5.0 inches, depending on the application of fragmentation device 100. Additionally, in a further embodiment, projections 104 may be non-planar.

Valleys 106 are recessed relative to projections 104 and may be angled inwardly relative to projections 104 to define a taper. In one illustrative embodiment, valleys 106 may be tapered at an angle $\alpha$ which is approximately 45° from the peak of valley 106 (see FIG. 2). In one illustrative embodiment, valleys 106 also may extend into body 101 by approximately 0.001 inches, 0.005 inches, 0.010 inches, 0.015 inches, 0.020 inches, 0.025 inches, 0.030 inches, 0.035 inches, 0.040 inches, 0.050 inches, or within any range delimited by any pair of the foregoing values. In this way, and as shown in FIG. 2, body 101 has a first thickness, t1, defined by the thickness at projections 104, and a second thickness, t2, defined by the thickness at valleys 106, and the second thickness is less than the first thickness. Because the thickness of body 101 at valleys 106 is reduced, valleys 106 define stress points on body 101 such that fragmentation of body 101 occurs at valleys 106.

Figure 3:
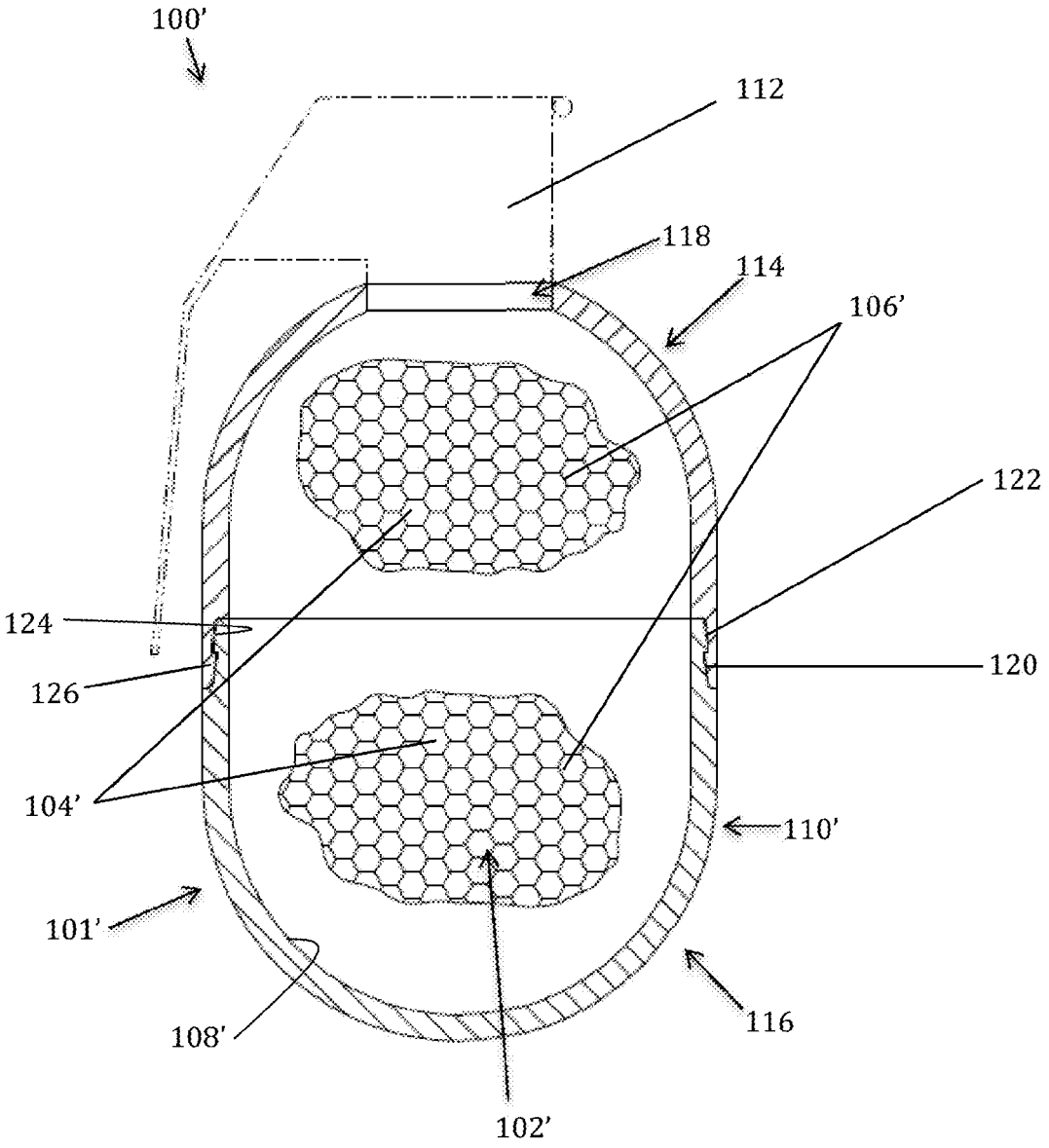
FIG. 3 is a cross-sectional view of an alternative fragmentation device of the present disclosure, illustrating a partial cut-away in a first portion and a partial cut-away in a second portion of the fragmentation device.
Figure 4:
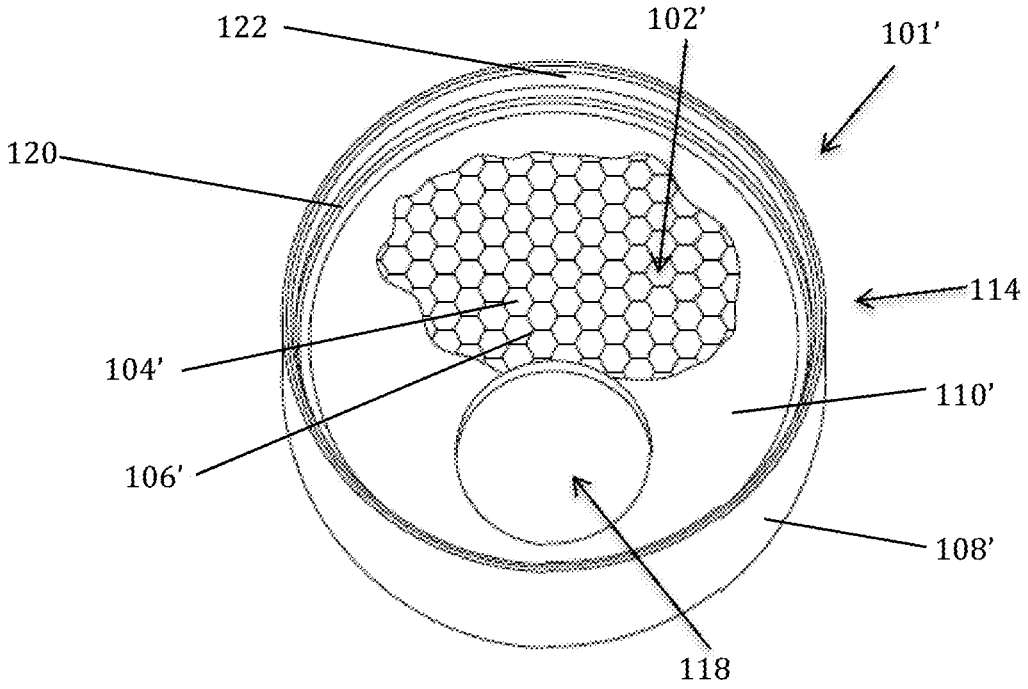
FIG. 4 is a perspective view of the first portion of the alternative fragmentation device of FIG. 3, illustrating a portion of a pattern on an inner surface of the fragmentation device.
Figure 5:
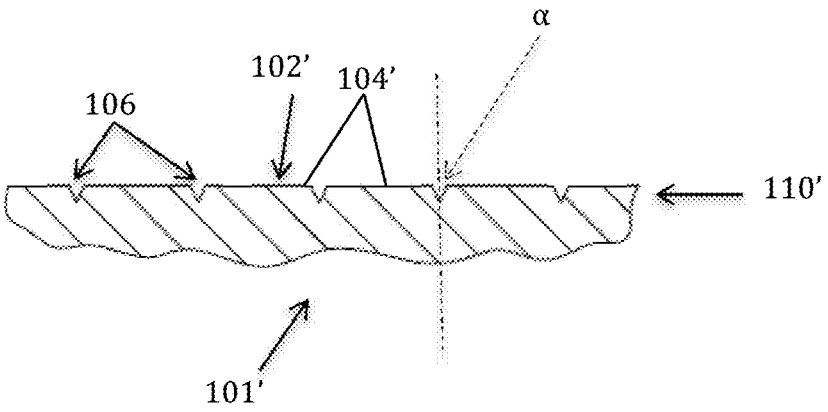
FIG. 5 is a cross-sectional view of a portion of the surface of the alternative fragmentation device of FIG. 3.

Referring to FIGS. 3-5, an alternative embodiment of fragmentation device 100 is shown as fragmentation device 100'. In one embodiment, fragmentation device 100' is a grenade configured to project a plurality of fragments during an explosive event. Fragmentation device 100' includes a body or fragmentation structure 101', explosive material 103, and a detonation device 112 (shown in phantom in FIG. 3) which is connected with explosive material 103 and coupled to body 101'. Body 101' includes a first portion 114 and a second portion 116 which are removably or permanently coupled together.

First portion 114 includes an aperture 118 for receiving detonation device 112. Additionally, first portion 114 includes a protruding member 120 and a recessed member 122, both extending circumferentially around an open end of first portion 114. Similarly, second portion 116 includes a protruding member 124 and a recessed member 126, both also extending circumferentially around an open end of second portion 116. More particularly, protruding member 120 of first portion 114 is configured to be received within recessed member 126 of second portion 116, and protruding member 124 of second portion 116 is configured to be received within recessed member 122 of first portion 114 in order to retain first and second portions 114, 116 together. Illustratively, first and second portions 114, 116 are coupled together through a snap-fit connection between protruding members 120, 124 and recessed members 122, 126. Other methods of coupling together first and second portions 114, 116 are also possible, such as welding, polymeric adhesives, a threaded connection, mechanical fasteners (e.g., bolts and nuts), etc. Alternatively, first and second portions 114, 116 may be integral with each other such that body 101' defines a unitary member.

Both first and second portions 114, 116 of fragmentation device 100' include an outer surface 108', which defines the outermost surface of body 101', and an inner surface 110', which defines the innermost surface of body 101'. In one embodiment, outer surface 108' is a smooth and continuous surface. However, exemplary inner surface 110' may include a grid 102' which includes a plurality of projections 104' and valleys 106'. As shown in FIGS. 3 and 4, grid 102' may define a honeycomb pattern on inner surface 110' of fragmentation device 100'. In one embodiment, grid 102' is defined on both inner surface 110' and outer surface 108'.

Projections 104' define the individual fragments of fragmentation device 100' such that when explosive material 103 ignites, body 101' is intended to fracture at each of valleys 106' and project the fragments, defined by each projection 104', outwardly. Illustratively, projections 104' define hexagonal fragments, however, projections 104' may be formed in any configuration to define differently shaped fragments. In one embodiment, the thickness of body 101' at projections 104' may be approximately 0.050 inches, 0.055 inches, 0.060 inches, 0.065 inches, 0.070 inches, 0.075 inches, 0.080 inches, 0.085 inches, 0.090 inches, 0.100 inches, or within any range delimited by any of the foregoing pairs of values. The thickness of body 101' also may be orders of magnitude greater, for example, 1.0-5.0 inches, depending on the application of fragmentation device 100'.

Valleys 106' are recessed relative to projections 104' and may be angled inwardly relative to projections 104' to define a taper. In one embodiment, valleys 106' may be tapered at an angle $\alpha$ which is approximately 45° from the peak of valley 106'. Valleys 106' also may extend into body 101' by approximately 0.001 inches, 0.005 inches, 0.010 inches, 0.015 inches, 0.020 inches, 0.025 inches, 0.030 inches, 0.035 inches, 0.040 inches, 0.050 inches, or within any range delimited by any pair of the foregoing values. In this way, body 101' has a first thickness, defined by the thickness at projections 104', and a second thickness, defined by the thickness at valleys 106', and the second thickness is less than the first thickness. Because the thickness of body 101' at valleys 106' is reduced, valleys 106' define stress points on body 101' such that fragmentation of body 101' occurs at valleys 106'.

Figure 6:
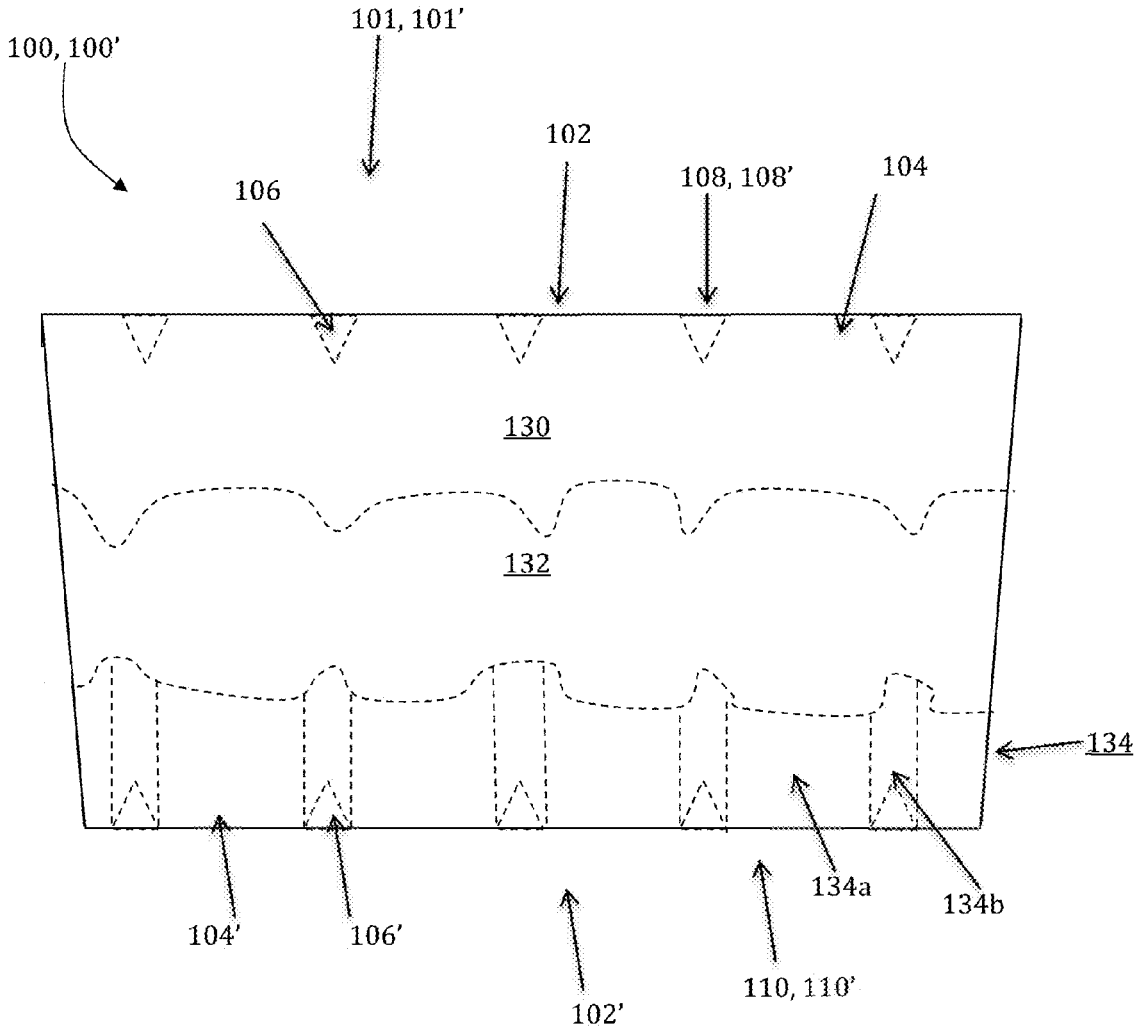
FIG. 6 is a schematic view of the surface of the fragmentation device of FIG. 2 and/or FIG. 3, illustrating different hardness values within the surface.

Referring to FIG. 6, body 101, 101' of fragmentation device 100, 100' may be comprised of a material with varying hardness throughout. For example, body 101, 101' may be comprised of steel, such as AISI 1008 carbon steel. In one embodiment, body 101, 101' is comprised of 1008 steel which contains at least carbon, manganese, phosphorus, sulfur, silicon, aluminum, boron, chromium, copper, nickel, niobium, nitrogen, tin, titanium, and vanadium. The steel comprising body 101, 101' may be low-carbon steel having a carbon content of approximately 0.01-2.0 wt. % carbon and, more particularly, may be 0.05 wt. % carbon.

While the entire thickness of body 101, 101' may be comprised of steel, the hardness of the steel of body 101, 101' may be different at different distances from outer surface 108, 108'. As shown in FIG. 6, body 101, 101' may include at least three depths or portions of material with varying hardness values. An outermost depth or portion 130 of body 101, 101' includes outer surface 108, 108', an innermost depth or portion 134 of body 101, 101' includes inner surface 110, 110', and an intermediate depth or portion 132 is positioned between outermost depth 130 and innermost depth 134. As shown in FIG. 6, outermost depth 130 or innermost depth 134 each may include a first section **134*a* defined by projections 104, 104' and a second section 134*b* defined by valleys 106, 106', intermediate depth 132 may define a third section of body 101, 101', and, if the other of outermost depth 130 and innermost depth 134 defines a fourth section of body 101, 101'. As shown in FIG. 6, first and second sections 134*a*, 134*b* are shown as being separated by phantom lines, however, it should be understood that first and second sections 134*a*, 134*b* are both within innermost depth 134 and, therefore, are comprised of the same material and are not physically separated sections of innermost depth 134**.

In one embodiment, outermost depth 130 has a hardness value which is greater than that of intermediate depth 132 and may be generally the same as innermost depth 134. However, in other embodiments, the hardness value of outermost depth 130 may be greater than or less than the hardness value of innermost depth 134. Illustrative depths 130, 132, 134 may have hardness values on the Rockwell C scale of 5, 10, 15, 20, 25, 30, 35, 40, 45, 50, 55, 60, 65, 70, 75, or within any range delimited by any pair of the foregoing values.

In order to adjust the hardness value of body 101, 101', depending on the distance from outer surface 108, 108', various processing methods may be used when forming body 101, 101'. For example, body 101, 101' may be subjected to a heat treatment process which may involve annealing, carburizing, carbonitriding, case hardening, precipitation strengthening, tempering, induction surface hardening, differential hardening, flame hardening, and quenching. Heat treatment processes may be used with metallic materials to adjust the strength and hardness of the material. More particularly, heat treatment processes may alter the physical and/or chemical properties of the material comprising body 101, 101' to modify the hardness, strength, toughness, ductility, and elasticity thereof.

In one embodiment, body 101, 101' undergoes a case hardening heat treatment process to increase the hardness of varying portions of body 101, 101'. In particular, case hardening is a process that may increase the hardness of outermost depth 130 and innermost depth 134 of body 101, 101' while allowing intermediate depth 132 to retain its natural physical properties (i.e., natural hardness). In this way, outermost and innermost depths 130, 134 have increased surface hardness relative to intermediate depth 132 which makes outermost and innermost depth 130, 134 slow to wear and increases the strength of fragmentation device 100, 100'. More particularly, case hardening creates a more brittle outermost and innermost depths 130, 134 while allowing intermediate depth 132 to remain more ductile and tougher relative to the outermost and innermost depths 130, 134.

For example, if body 101, 101' is comprised of steel, a carburizing process is one method of creating a case hardened fragmentation device 100, 100'. Carburizing occurs by positioning body 101, 101' within a carbon-rich environment and then heating body 101, 101' to a predetermined temperature. More particularly, carburizing is the addition of carbon to a surface of low-carbon steels at temperatures of 750° C., 800° C., 850° C., 900° C., 950° C., 1000° C., 1050° C., 1100° C., 1150° C., 1200° C., or within any range delimited by any of the foregoing pairs of values. While held at a specific temperature, the material comprising body 101, 101' absorbs some of the surrounding carbon content, which may be provided by carbon monoxide gas and/or other sources of carbon. By increasing the carbon content at outer surface 108, 108' and inner surface 110, 110', the material at those portions of body 101, 101' will have increased hardness relative to the portions of body 101, 101' which were not directly exposed to the carbon. In one embodiment, the carbon content at outer surface 108, 108' and/or inner surface 110, 110' increases from approximately 0.05 wt. % carbon to approximately 0.2 wt. % carbon.

Additionally, the length of time that body 101, 101' is carburized may vary, depending on the depth within body 101, 101' that carbon is intended to penetrate. For example, when body 101, 101' is positioned within the carbon-rich environment for longer periods of time, carbon is absorbed deeper into body 101, 101' such that some amount of carbon may be absorbed into intermediate depth 132, rather than just absorbed at outermost and innermost depths 130, 134. However, if carburizing occurs for shorter amounts of time, carbon is not absorbed within intermediate depth 132 such that intermediate depth 132 retains the natural ductility of the material comprising body 101, 101'. As such, intermediate depth 132 has reduced hardness and increased ductility relative to outermost and innermost depths 130, 134. More particularly, when heated within the carburizing chamber (not shown), austenite has a high solubility for carbon such that carbon is absorbed into outermost and innermost depths 130, 134 but not into intermediate depth 132. When cooled, for example by quenching, the higher-carbon content at outermost and innermost depths 130, 134 forms martensite which has good wear and fatigue resistance. In one embodiment, a carburizing process may be combined with other heat treatment processes, such as nitriding, induction surface hardening, differential hardening, and/or flame hardening, to modify the hardness of body 101, 101'. Additional details of a carburizing process may be disclosed in U.S. Pat. No. 4,152,177, which issued on May 1, 1979, the complete disclosure of which is expressly incorporated by reference herein.

As shown in FIG. 6, the carbon profile of outermost depth 130 and/or innermost depth 134 may not be planar because similar amounts of carbon are absorbed into outermost depth 130 and/or innermost depth 134 through both projections 104, 104' and valleys 106, 106'. However, because the thickness of body 101, 101' at projections 104, 104' is greater than the thickness of body 101, 101' at valleys 106, 106', carbon may penetrate deeper into outermost depth 130 and/or innermost depth 134 at valleys 106, 106' when compared to the carbon penetration depth at projections 104, 104'. As such, the carbon profile of outermost depth 130 and/or innermost depth 134 may not be planar, but instead, may follow the thickness profile of body 101, 101' at projections 104, 104' and valleys 106, 106'. In this way, the boundary defining intermediate depth 132, the portion of body 101, 101' which maintains its original carbon content and is not hardened through the carburizing process, also may not be planar.

By increasing the hardness of portions of body 101, 101', those portions thereof may become more brittle. As such, those portions of body 101, 101' may undergo brittle fracture rather than elastic or plastic deformation during an explosive event. More particularly, because fragmentation device 100, 100' is an explosive device, by using a case hardening process, such as carburization, when manufacturing fragmentation device 100, 100', body 101, 101' may be configured to uniformly project the individual fragments, defined by the individual projections 104, 104', at a high rate of speed. Additionally, because various portions of body 101, 101' are made more brittle through a case hardening process, body 101, 101' may be more likely to fracture at each valley 106, 106', thereby increasing the number of fragments formed during an explosive event of fragmentation device 100, 100'.

Figure 7:
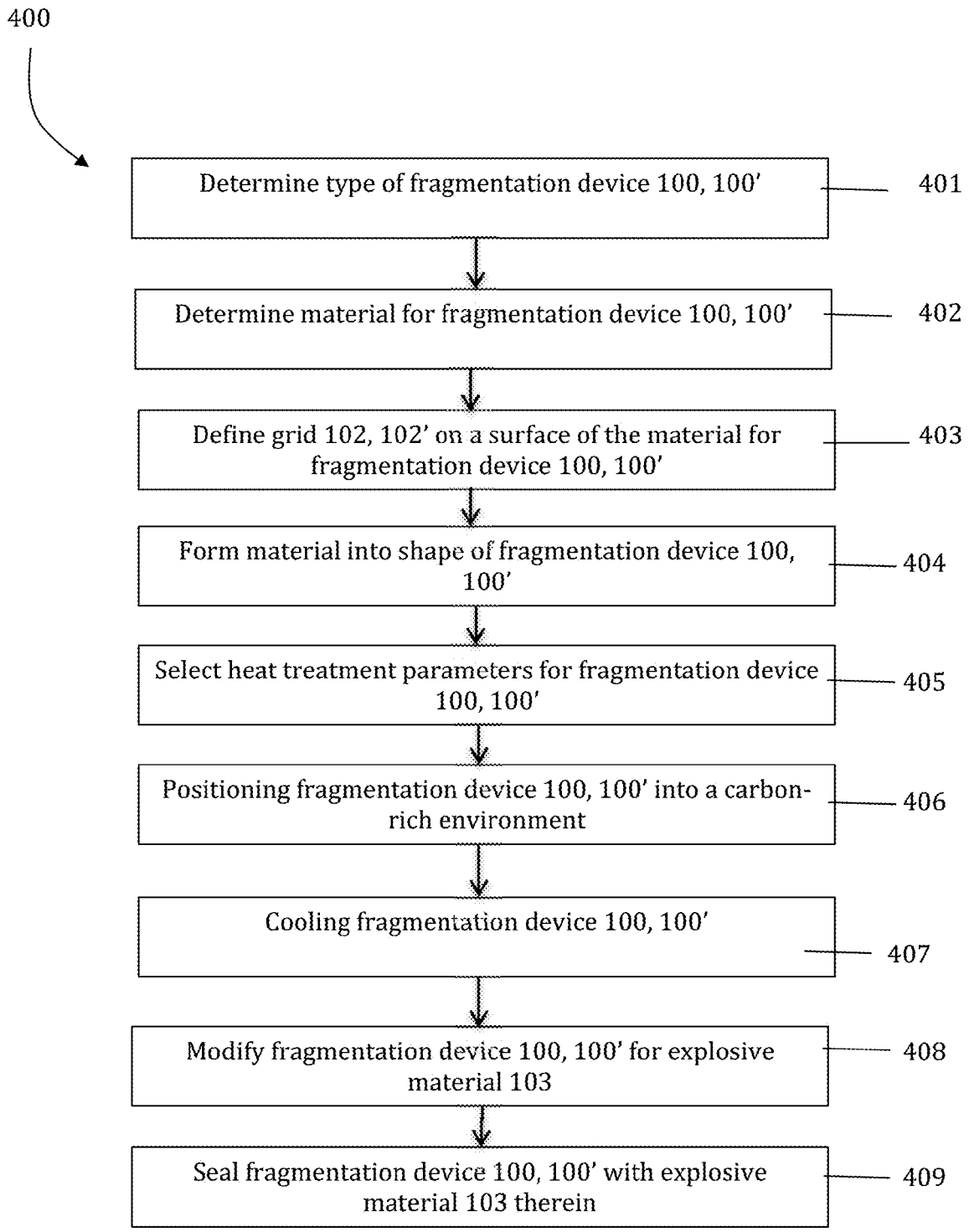
FIG. 7 is a flow chart of an exemplary method of producing a fragmentation device of the present disclosure.

FIG. 7 illustrates an exemplary method 400 of manufacturing fragmentation device 100, 100'. For example, in a first step 401, it is determined what type of fragmentation device 100, 100' is to be formed. For example, fragmentation device 100, 100' may be selected to form a military device, such as a grenade or other type of ammunition. Alternatively, fragmentation device 100, 100' may be selected to form a non-military device, such as a hard drive or an electrical component. Whichever type of fragmentation device 100, 100' is selected, fragmentation device 100, 100' is intended to be destroyed or rendered inoperable after actuation of fragmentation device 100, 100' occurs to define a plurality of fragments. A second step 402 includes determining available material options for both body 101, 101' and explosive material 103, depending on the type of fragmentation device 100, 100' selected, the size of fragmentation device 100, 100', and/or the application of fragmentation device 100, 100'. In one embodiment, second step 402 includes providing a flat sheet or panel of the material selected for body 101, 101'.

In a third step 403, the material selected in second step 402 for body 101, 101' may be etched, cast, machined, stamped, pressed, or otherwise imprinted with grid 102, 102' to define projections 104, 104' and valleys 106, 106'. As shown in FIGS. 1 and 3, grid 102, 102' may be applied to body 101, 101' to define square-shaped fragments and/or hexagonal fragments. Additionally, grid 102, 102' may be applied to outer surface 108, 108' and/or inner surface 110, 110'.

In a fourth step 404, after imprinting grid 102, 102' onto the material selected in second step 402 for body 101, 101', that material of body 101, 101' may be formed into the desired shape for fragmentation device 100, 100'. For example, the material selected for body 101, 101' may be drawn or otherwise shaped into the overall fragmentation device 100, 100' or into various components of fragmentation device 100, 100', such as first portion 114 and second portion 116.

A fifth step 405 may occur before or after fourth step 404 and includes selecting processing parameters for body 101, 101'. More particularly, depending on the application of fragmentation device 100, 100', it may be desired to modify the material properties of body 101, 101'. For example, it may be desired to increase the hardness of outermost and/or innermost depths 130, 134 (FIG. 6) through a heat treatment process, such as a carburizing case hardening process. Therefore, in fifth step 405, material strength and degradation data may be analyzed to determine the parameters of the heat treatment process. For example, heat treatment parameters, such as temperature, exposure time, cooling temperature and time, and/or concentration of carbon (when the heat treatment is a carburizing process), may be identified and selected in fifth step 405.

If a carburizing case hardening process is selected in fifth step 405, a sixth step 406 includes placing body 101, 101' into a carbon-rich environment, such as a carburizing chamber, which includes a quantity of carbon. In one embodiment, the carbon-rich environment may be created by surrounding the selected material with carbon monoxide or any other carbon rich substance. While in the carbon-rich environment, body 101, 101' may be heated to a predetermined temperature, as determined in fifth step 405. The predetermined temperature and the exposure time may vary, with higher temperatures and longer exposure times resulting in a more brittle material due to increased penetration or absorption of carbon deeper into body 101, 101'. During sixth step 406, the material of body 101, 101' absorbs some of the carbon from the surrounding environment. Longer exposure times mean more carbon may be absorbed into the material, which may result in a more brittle body 101, 101'. More particularly, because body 101, 101' defines an open first portion 114 and an open second portion 116, both outermost and innermost depths 130, 134 may be exposed to the carbon-rich environment. As such, the material properties at both outermost and innermost depths 130, 134 of body 101, 101' may be modified during the heat treatment of sixth step 406. In one embodiment, if body 101, 101' is comprised of steel, then by heat treating the material of body 101, 101' in a carbon-rich environment during sixth step 406, outermost and innermost depths 130, 134 may undergo a phase transformation to martensite with a body centered tetragonal ("BCT") crystal structure, thereby increasing the brittleness and hardness at outermost and innermost depths 130, 134 relative to intermediate depth 132. Intermediate depth 32 may maintain the natural hardness of the material of body 101, 101', depending on the heat treatment parameters (e.g., exposure time).

Following sixth step 406, body 101, 101' may be cooled during a seventh step 407. In one embodiment, body 101, 101' may be quenched during seventh step 407. During seventh step 407, cooling allows the material of body 101, 101' to capture the carbon it absorbed during sixth step 406.

Once the heat treatment cycle is completed, body 101, 101' may be further modified in an eighth step 408 to include additional features of fragmentation device 100, 100'. For example, first portion 114 may be further modified to include aperture 118 for receiving explosive material 103 and detonation device 112. After explosive material 103 is received within fragmentation device 100, 100', fragmentation device 100, 100' may be sealed in a ninth step 409. For example, first and second portions 114, 116 may be coupled together and/or detonation device 112 may be sealed against body 101, 101'. In one embodiment, first and second portions 114, 116 may be snap fit, adhesively bonded, welded, coupled together with mechanical fasteners, or otherwise coupled together through any conventional process to contain explosive material 103 therein.

Because outermost and/or innermost depths 130, 134 of body 101, 101' are made more brittle through the heat treatment process, fragmentation device 100, 100' is configured for approximately 100% fragmentation along valleys 106, 106' when explosive material 103 is ignited with detonation device 112. More particularly, the combination of increasing the hardness of outermost and/or innermost depths 130, 134 of body 101, 101' and providing body 101, 101' with valleys 106, 106', which define stress points within body 101, 101', allows for increased fragmentation of fragmentation device 100, 100' during an explosive event.

Alternative embodiments of a fragmentation device also may be manufactured according to the disclosure of FIGS. 1-12. For example, a fragmentation device may be a computer hard drive 140, as shown in FIG. 13. More particularly, hard drive 140 includes a read/write head 142, a sector 144, a track 146, a platter 148, and surfaces 150. In one embodiment, surfaces 150 of hard drive 140 include valleys 152 and may be hardened relative to an intermediate depth of surfaces 150 through the above-disclosed carburizing process. In this way, if surfaces 150 and/or other components of hard drive 140 are configured to fragment during predetermined conditions, brittle fracture occurs at valleys 152 on surfaces 150 shaft because surfaces 150 have increased hardness relative to other portions or depths of surfaces 150 as a result of the carburizing process. Additionally, during the carburizing process and, more particularly, during seventh step 407 when surfaces 150 are cooled after the carburizing process, magnetic fields or dipoles of hard drive 140 may be aligned.

Additionally, other alternative embodiments of the fragmentation device are contemplated. For example, a hollow screw (not shown) may have increased surface hardness according to the method of FIG. 7. More particularly, the hollow screw may include only every other thread on its shaft such that a gap exists between rows of threads. Rather than including another thread, a recess similar to valleys 106, 106', 152 may be included in the gaps to define a fragmentation location on the screw. In this way, if the screw is configured to fragment during predetermined conditions, brittle fracture occurs at the valleys on the screw shaft because the surface of the screw shaft has increased hardness relative to other portions or depths of the screw shaft as a result of the carburizing process.

The above-disclosed method of increasing the surface hardness of an object and, more particularly, increasing the surface hardness of an object at a defined fragmentation or fracture location, may be applied to other objects, as well. For example, brake discs, electrical components, and any other device intended for fragmentation or fracture.

EXAMPLES

Figure 8:
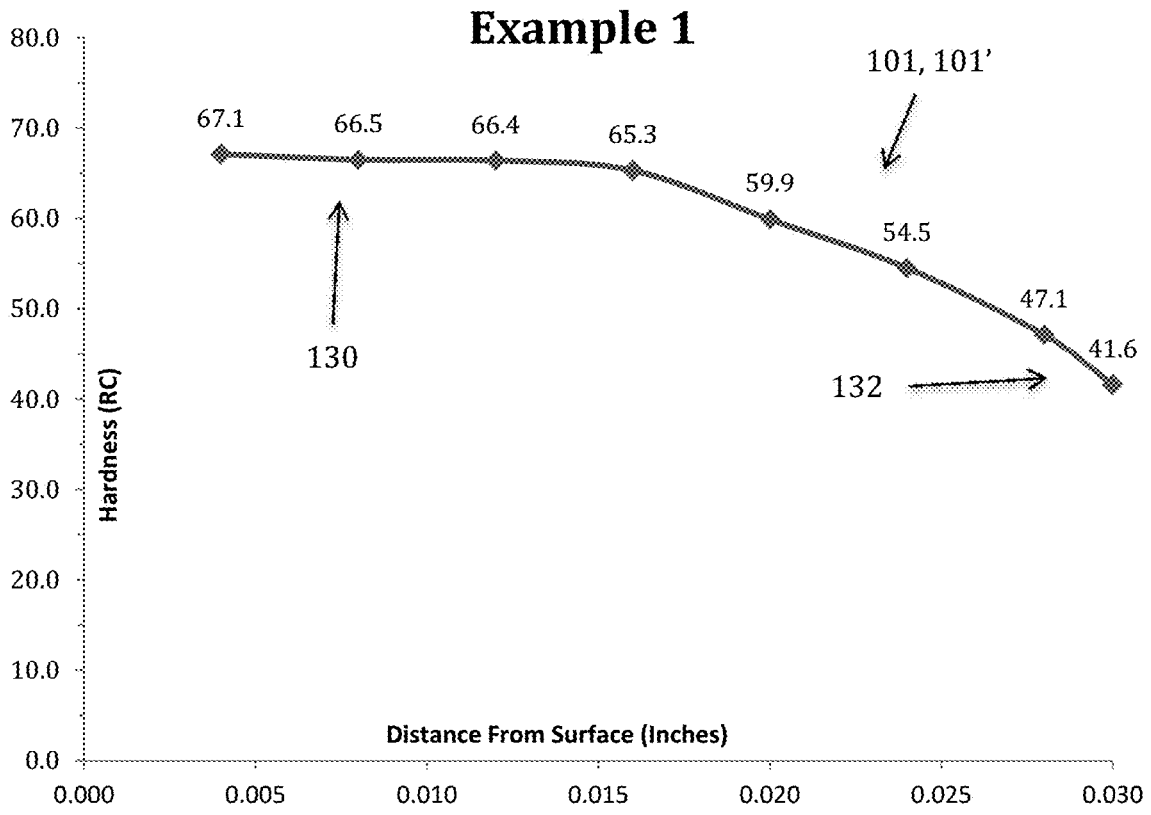
FIG. 8 is a graphical representation of the hardness values of the surface of an exemplary fragmentation device of the present disclosure.

To achieve increased fragmentation during an explosive event, the heat treatment process may be adjusted to modify the hardness of various portions of body 101, 101' according to predetermined parameters. More particularly, body 101, 101' of Example 1 (FIG. 8) may be carburized to increase the carbon content at outermost depth 130 and/or innermost depth 134 relative to intermediate depth 132 (FIG. 6). For example, as shown in FIG. 8, Example 1 of fragmentation device 100, 100' may include a hardness value at outermost depth 130 of body 101, 101' of 65-70 Rockwell C and, more particularly, a hardness value of 65.3-67.1 Rockwell C. However, as the distance from outermost depth 130 increases toward intermediate depth 132, the hardness of body 101, 101' decreases to a hardness value of 40-60 Rockwell C and, more particularly, 41.6-59.9 Rockwell C. In this way, intermediate depth 132 has more ductility than outermost depth 130 of body 101, 101'. However, by increasing the carbon content at outermost depth 130, the hardness at outermost depth 130 also increases and brittle fracture may occur more easily at each valley 106, 106' such that increased fragmentation occurs in fragmentation device 100, 100'.

Figure 9:
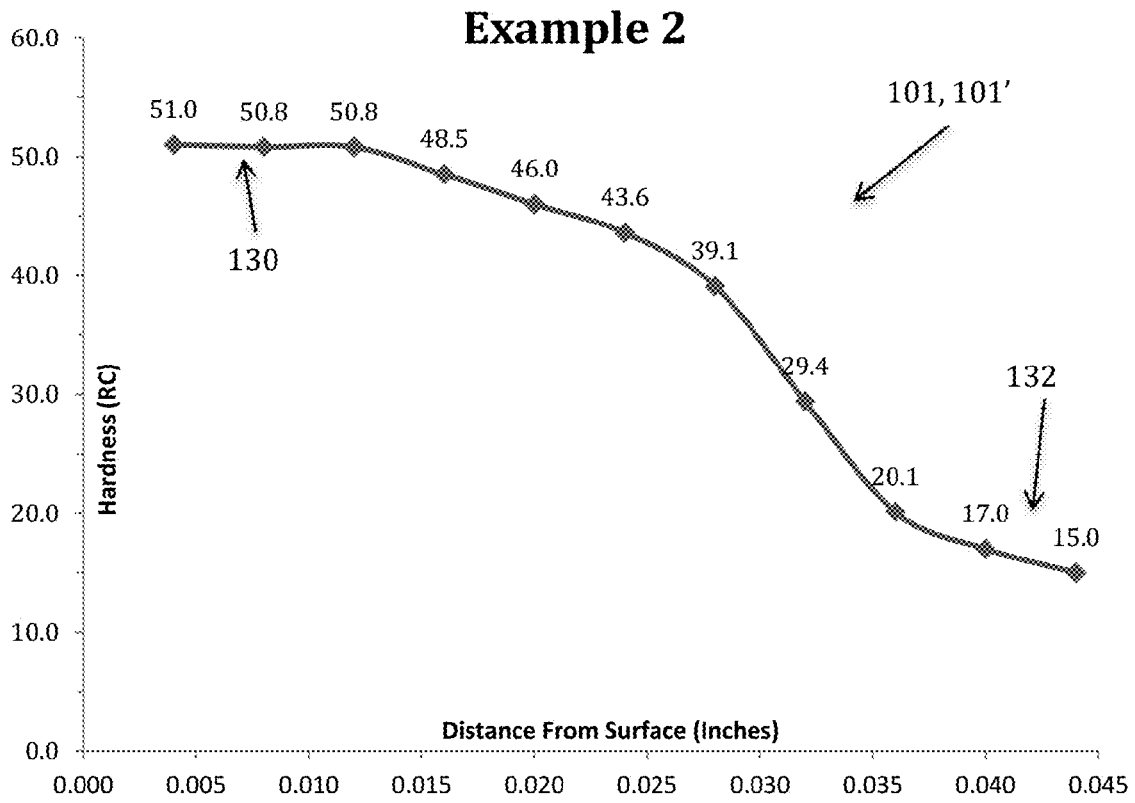
FIG. 9 is a graphical representation of the hardness values of the surface of another exemplary fragmentation device of the present disclosure.

Similarly, as show in Example 2 of FIG. 9, body 101, 101' of Example 2 may be carburized to increase the carbon content at outermost depth 130 and/or innermost depth 134 relative to intermediate depth 132 (FIG. 6). By increasing the carbon content at outermost depth 130 and/or innermost depth 143, the hardness of those portions of body 101, 101' increases. For example, the hardness values at outermost depth 130 of body 101, 101' may be 40-55 Rockwell C and, more particularly, a hardness value of 43.6-51.0 Rockwell C. However, as the distance from outermost depth 130 increases toward intermediate depth 132, the hardness of body 101, 101' decreases to a hardness value of 10-40 Rockwell C and, more particularly, 15.0-39.1 Rockwell C. In this way, intermediate depth 132 has more ductility than outermost depth 130 of body 101, 101'. However, by increasing the carbon content at outermost depth 130, the hardness at outermost depth 130 also increases and brittle fracture may occur more easily at each valley 106, 106' such that increased fragmentation occurs in fragmentation device 100, 100'.

Figure 10:
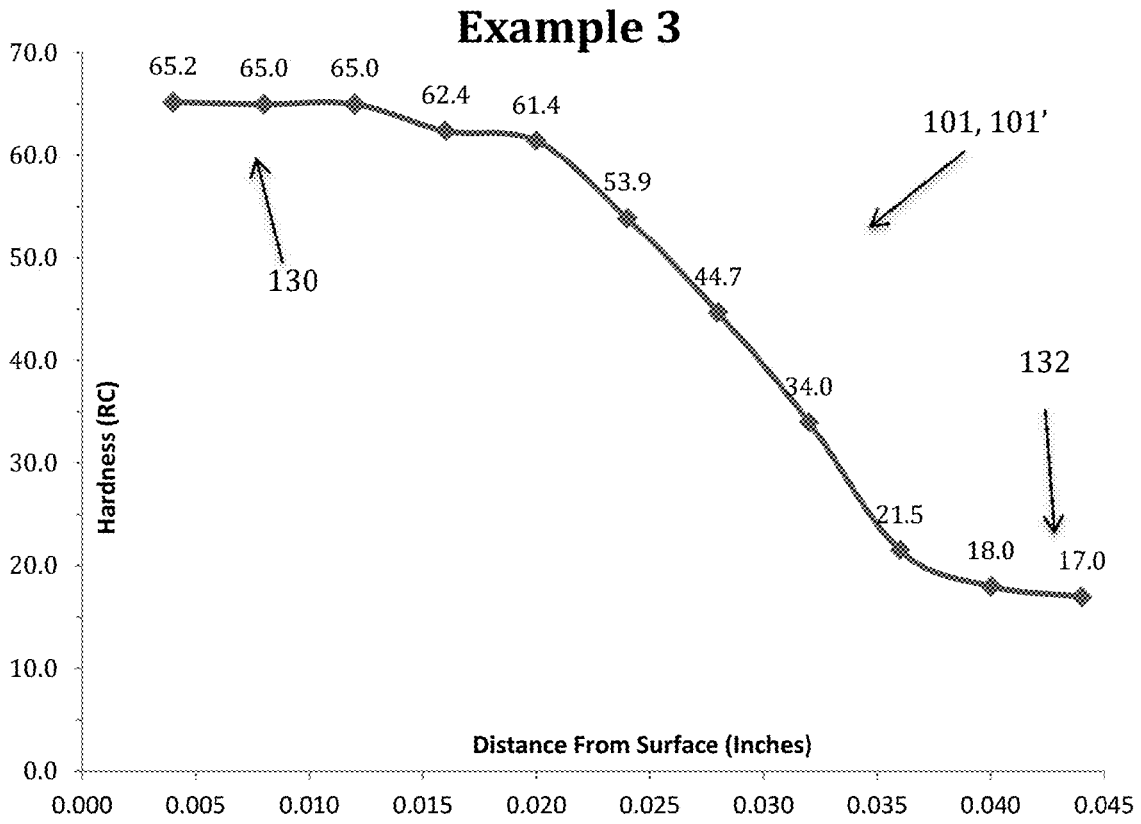
FIG. 10 is a graphical representation of the hardness values of the surface of a further exemplary fragmentation device of the present disclosure.

Additionally, as show in Example 3 of FIG. 10, body 101, 101' of Example 3 may be carburized to increase the carbon content at outermost depth 130 and/or innermost depth 134 relative to intermediate depth 132 (FIG. 6). By increasing the carbon content at outermost depth 130 and/or innermost depth 143, the hardness of those portions of body 101, 101' increases. For example, the hardness values at outermost depth 130 of body 101, 101' may be 60-70 Rockwell C and, more particularly, a hardness value of 61.4-65.2 Rockwell C. However, as the distance from outermost depth 130 increases toward intermediate depth 132, the hardness of body 101, 101' decreases to a hardness value of 10-60 Rockwell C and, more particularly, 17.0-53.9 Rockwell C. In this way, intermediate depth 132 has more ductility than outermost depth 130 of body 101, 101'. However, by increasing the carbon content at outermost depth 130, the hardness at outermost depth 130 also increases and brittle fracture may occur more easily at each valley 106, 106' such that increased fragmentation occurs in fragmentation device 100, 100'.

Figures 11A, 11B:
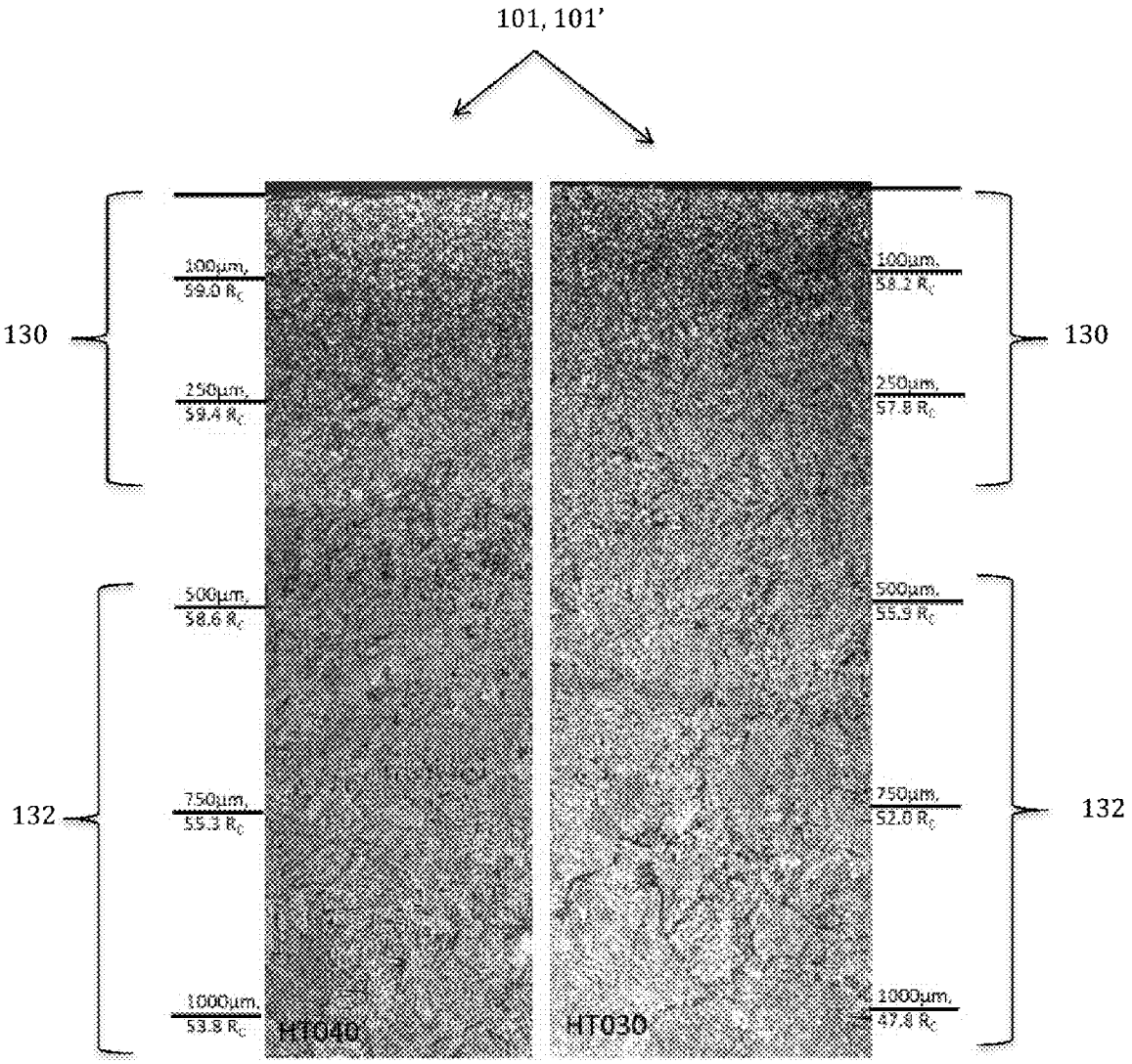
FIG. 11A is a first micrograph of the surfaces of an exemplary fragmentation device of the present disclosure.
FIG. 11B is a second micrograph of the surfaces of an exemplary fragmentation device of the present disclosure.

Referring to FIGS. 11A and 11B, two different samples of body 101, 101', processed at different conditions during the heat treatment cycle, are shown. FIGS. 11A and 11B show that the microstructure of outermost depth 130 of body 101, 101' is different from the microstructure of intermediate depth 132 of body 101, 101'. More particularly, the microstructure of body 101, 101' changes as the distance from outer surface 108, 108' increases because less carbon is absorbed at an increased distance within body 101, 101' during the heat treatment process. As such, the microstructure at outermost depth 130 shows a martensite phase structure which is different from the microstructure at intermediate depth 132, which may be austenite or another phase of steel.

Figure 12:
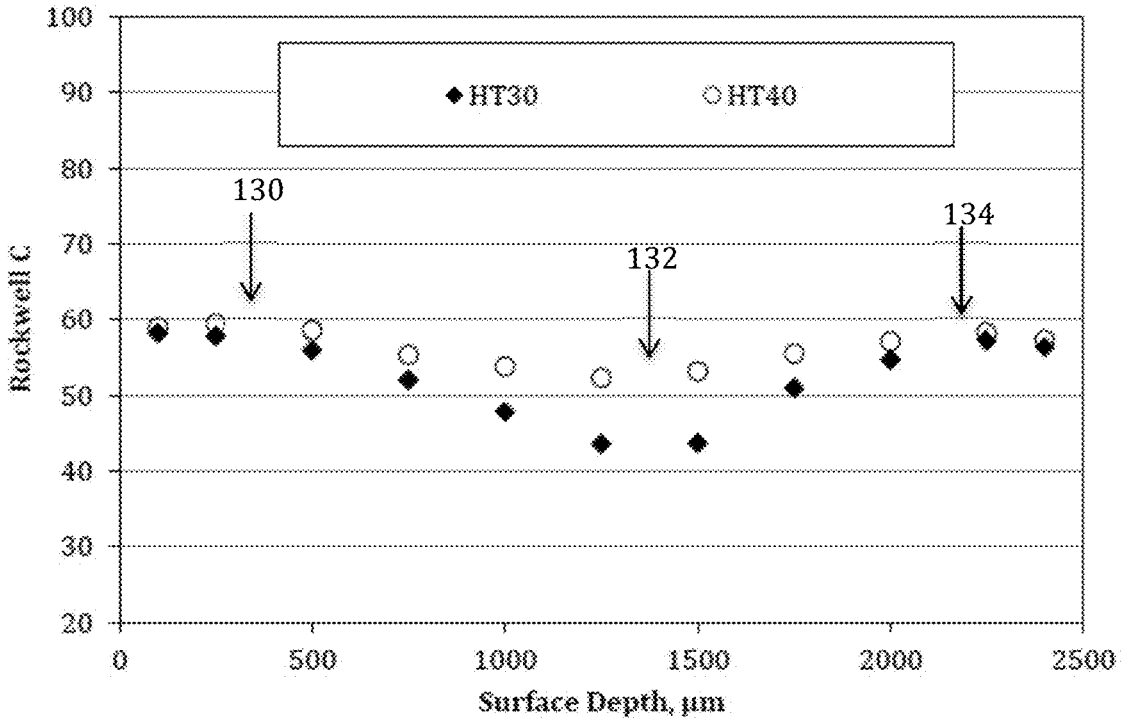
FIG. 12 is a graphical representation of the hardness values associated with the two micrographs of FIGS. 11A and 11B.
Figures 13A, 13B:
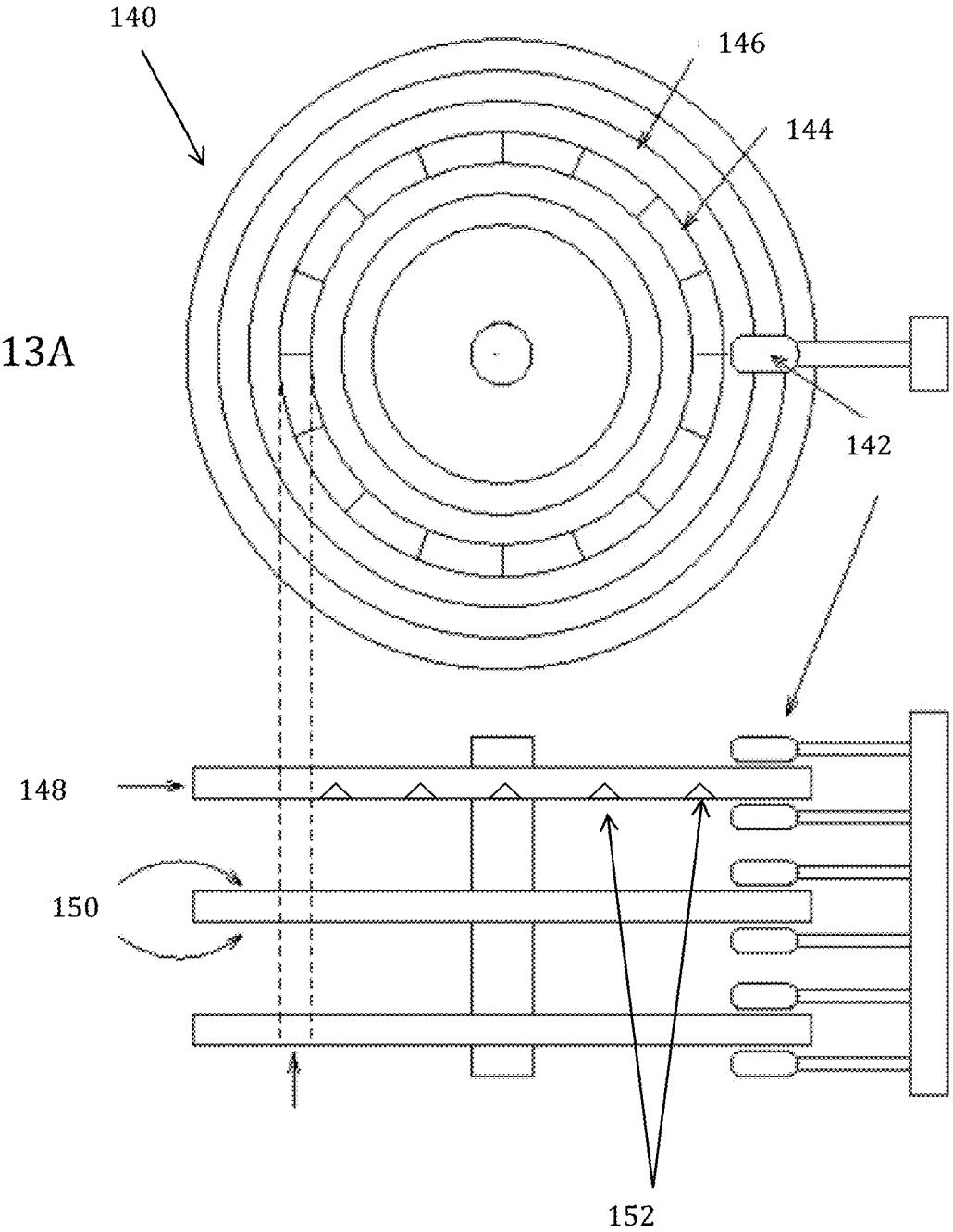
FIG. 13A is a top view of an exemplary hard drive with increased surface hardness at a portion of the hard drive, according to present disclosure.
FIG. 13B is a side view of the exemplary hard drive of FIG. 13A.

Referring to FIG. 12, the hardness values of body 101, 101' of the two different samples of FIGS. 11A and 11B were plotted relative to each other and based on the distance from outer surface 108, 108'. As shown in FIG. 12, the hardness values for each sample at outermost and innermost depths 130, 134 are approximately the same and greater than the hardness value at intermediate depth 132. In this way, brittle fracture occurs more easily at valleys 106, 106', which define stress points within body 101, 101', during an explosive event due to the combination of valleys 106, 106' and the modification of the hardness of body 101, 101'. As such, fragmentation device 100, 100' allows for increased fragmentation during an explosive event.

Although the invention has been described in detail with reference to certain preferred embodiments, variations and modifications exist within the spirit and scope of the invention as described and defined in the following claims.

What is claimed:

1. A method of modifying material properties of a fragmentation device, comprising:

providing a fragmentation device with a first surface, a first section extending from the first surface, a second section disposed on at least one side of the first section and extending from the first surface, a second surface spaced apart from the first surface, a third section extending from the second surface, and a fourth section disposed between the first, second, and third sections, the first section of the fragmentation device having a first thickness and the second section of the fragmentation device having a second thickness less than the first thickness, and an area of the first surface being greater than an area of the second surface;

positioning the fragmentation device within a carbon-rich environment;

increasing the temperature within the carbon-rich environment up to 1,200° C.;

absorbing carbon from the carbon-rich environment into the first and second surfaces of the fragmentation device;

increasing a content of carbon at the first and second surfaces to 0.06 wt. % carbon to 1.0 wt. % carbon; and maintaining an original content of carbon at 0.01 wt. % carbon to 0.05 wt. % carbon at the fourth section of the fragmentation device by controlling penetration of the carbon into the fourth section.

2. The method of claim 1, further comprising absorbing the carbon to a first depth with the first section and absorbing the carbon to a second depth within the second section, the first depth being less than the second depth relative to the first surface, and the first and second depths being less than a depth of the fourth section relative to the first surface.

3. The method of claim 1, wherein the first thickness is 0.5-1.0 inches and the second thickness is 0.45-0.99 inches relative to the first surface.

4. The method of claim 1, wherein increasing the content of carbon at the first and second surfaces includes increasing a hardness of the first and second surfaces to 50-70 Rockwell C.

5. The method of claim 1, wherein maintaining the original content of carbon at the fourth section includes maintaining a hardness of the third section at 10-50 Rockwell C.

6. A method of manufacturing a fragmentation device, comprising:

selecting a material for a fragmentation device, the material including a first surface, a second surface generally opposite the first surface, and an intermediate section disposed between the first and second surfaces, an area of the first surface being greater than an area of the second surface;

forming a plurality of first sections and a plurality of second sections extending from the first surface, each of the second sections being disposed along at least one side of each of the first sections, and a thickness of the first sections being greater than a thickness of the second sections;

forming the material into a shape defining the fragmentation device;

increasing a carbon content of the first and second surfaces of the material;

maintaining a carbon content of the intermediate section by controlling penetration of carbon into the intermediate section; and positioning an energetic device within the fragmentation device.

7. The method of claim 6, wherein a hardness of the first and second surfaces of the material is generally equal.

8. The method of claim 6, wherein a hardness of the intermediate section of the material is less than the hardness of the first and second surfaces.

9. The method of claim 6, wherein increasing the carbon content of the first and second surfaces includes positioning the material within a carbon-rich environment.

10. The method of claim 9, wherein increasing the carbon content of the first and second surfaces includes elevating the temperature of the carbon-rich environment to a temperature configured to form a martensitic phase within the first surface of the material.

11. The method of claim 10, wherein the temperature of the carbon-rich environment is up to 1,200° C.

12. The method of claim 6, wherein the thickness of the first sections is 0.5-1.0 inches and the thickness of the second sections is 0.45-0.99 inches relative to the first surface.

13. The method of claim 6, further comprising absorbing carbon to a first depth with the first section and absorbing the carbon to a second depth within the second section, the first depth being less than the second depth relative to the first surface, and the first and second depths being less than a depth of the intermediate section relative to the first surface.

14. A fragmentation device, comprising:

a fragmentation structure with a first surface, a first section extending inwardly from the first surface, a second section disposed on at least one side of the first section and extending inwardly from the first surface, a second surface spaced apart from the first surface, a third section extending from the second surface, and a fourth section disposed between the first, second, and third sections, the first section of the fragmentation structure having a first thickness and the second section of the fragmentation structure having a second thickness less than the first thickness, a carbon content of the first and second sections being greater than a carbon content of the fourth section, and an area of the first surface being greater than an area of the second surface; and an energetic device positioned within the fragmentation structure.

15. The fragmentation device of claim 14, wherein the thickness of the first sections is 0.5-1.0 inches and the thickness of the second sections is 0.45-0.99 inches relative to the first surface.

16. The fragmentation device of claim 14, wherein the first surface has a first hardness of 50-70 Rockwell C.

17. The fragmentation device of claim 16, wherein the second surface has a second hardness of 50-70 Rockwell C.

18. The fragmentation device of claim 17, wherein the fourth section of the fragmentation structure has a third hardness of 10-50 Rockwell C.

19. The fragmentation device of claim 14, wherein the second section of the first surface has a tapered configuration with a narrowing width extending inwardly from the first surface.

* * * * *